US005120431A

United States Patent [19]

Cordonnier

[11] Patent Number: 5,120,431

[45] Date of Patent: Jun. 9, 1992

[54] PNEUMATIC CENTRIFUGAL SEPARATOR

[75] Inventor: Alain Cordonnier, Lille, France

[73] Assignee: FCB, Montreuil, France

[21] Appl. No.: 655,327

[22] Filed: Feb. 12, 1991

[30] Foreign Application Priority Data

Feb. 13, 1990 [FR] France ..... 90 01673

[51] Int. Cl.[5] ..... B07B 7/01; B07B 7/02; B07B 7/083

[52] U.S. Cl. ..... 209/135; 209/142; 209/144; 209/145; 209/148

[58] Field of Search ..... 209/132-135, 209/139.2, 140-145, 148

[56] References Cited

U.S. PATENT DOCUMENTS

| | | | |
|---|---|---|---|
| 1,281,881 | 10/1918 | Thuneman | 209/143 |
| 3,234,716 | 2/1966 | Sevin et al. | 209/144 X |
| 4,260,478 | 4/1981 | Hosokawa et al. | 209/144 X |
| 4,551,241 | 11/1985 | Saverse et al. | 209/148 |
| 4,661,244 | 4/1987 | Hanke et al. | 209/148 X |
| 4,689,141 | 8/1987 | Folsberg | 209/144 |
| 4,693,811 | 9/1987 | Lohnherr | 209/148 X |
| 4,818,376 | 4/1989 | Tanaka et al. | 209/135 |
| 4,869,786 | 9/1989 | Hanke | 209/148 X |

FOREIGN PATENT DOCUMENTS

| | | | |
|---|---|---|---|
| 0535314 | 10/1931 | Fed. Rep. of Germany UX | 209/144 |
| 0241869 | 1/1987 | Fed. Rep. of Germany | 209/144 |
| 3741650 | 12/1988 | Fed. Rep. of Germany | 209/132 |
| 3808023 | 9/1989 | Fed. Rep. of Germany | 209/139.2 |
| 0563197 | 6/1977 | U.S.S.R. | 209/144 |
| 0943484 | 7/1982 | U.S.S.R. | 209/139.2 |

*Primary Examiner*—Michael S. Huppert
*Assistant Examiner*—Edward M. Wacyra
*Attorney, Agent, or Firm*—Collard, Roe & Galgano

[57] ABSTRACT

A pneumatic centrifugal separator comprises guide vanes disposed along the generatrices of a fictitious cylinder having a vertical axis, the guide vanes being adapted to impart to a gas stream entering the fictitious cylinder a rotary motion about the vertical cylinder axis, and a rotor coaxially positioned in the interior of the fictitious cylinder, the rotor being equipped with a first set of vertical blades distributed uniformly along the periphery of the fictitious cylinder and a second set of blades disposed between the blades of the first set and the cylinder axis. A gas stream and particulate material to be sorted is introduced between the guide vanes and the rotor, and the gas stream charged with particles of dimensions smaller than predetermined dimensions and sorted out of the particulate material is drawn out of a central outlet. The second set of blades is arranged to guide the streams of gas coming through channels between adjacent vertical blades of the first set to the central outlet.

12 Claims, 3 Drawing Sheets

PNEUMATIC CENTRIFUGAL SEPARATOR

BACKGROUND OF THE INVENTION

1. Field of the Invention

The present invention relates to a pneumatic centrifugal separator for sorting particulate material so that solid particles of a size exceeding that of a predetermined dimension are separated from a flow of solid particles suspended in a stream of gas, which separator comprises guide vanes disposed along the generatrices of a fictitious cylinder having a vertical axis, the guide vanes being adapted to impart to a gas stream entering the fictitious cylinder a rotary motion about the vertical cylinder axis, a rotor coaxially positioned in the interior of the fictitious cylinder, the rotor being equipped with a set of vertical blades distributed uniformly along the periphery of the fictitious cylinder, means for introducing a gas stream and particulate material to be sorted between the guide vanes and the rotor, and a central outlet through which the gas stream charged with particles of dimensions smaller than the predetermined dimension and sorted out of the particulate material is drawn out.

2. Description of the Prior Art

A separator of this general type has been disclosed in U. S. Pat. No. 4,689,141. In such separators, the particles suspended in the gas stream are subjected to two opposing forces: a centrifugal force resulting from the rotary motion and a drawing force resulting from the centripetal flow of the gas stream towards the central outlet. The separation of the large particles is effected at the cylindrical outer surface of the rotor. If the distribution of the gas stream over the entire height of the turbine rotor is uniform, there is a single critical or cut-off particle diameter determining the sorting of the particles, which corresponds to that of a particle in equilibrium on the exterior surface of the rotor. The particles having a diameter exceeding the critical or cutoff diameter are thrown back against the guide vanes by the centrifugal force and fall by gravity into a collecting hopper positioned below the guide vanes. The particles whose diameter is smaller than the critical or cut-off diameter are entrained by the gas stream across the rotor towards the central outlet.

In the known separators of this type, the rotor is equipped with rather small blades along its periphery and, in operation, a vortex is formed in the center of the rotor, in which a substantial part of the kinetic energy of the gas stream is dissipated.

SUMMARY OF THE INVENTION

It is the primary object of this invention to improve the performance and to reduce the energy consumption of separators of the indicated type by arrangements which permit the gas stream to flow between the guide vanes and the rotor without substantial turbulence, and the formation of a vortex in the rotor to be avoided.

The above and other objects are accomplished according to the invention in a separator of the first-described structure by equipping the rotor with a second set of blades disposed between the blades of the first set and the cylinder axis, the second set of blades being arranged to guide the streams of gas coming through channels between adjacent ones of the vertical blades of the first set to the central outlet.

The blades of the second set preferably extend over the entire height of the rotor and may define radially extending planes, or they may be inclined with respect to radial planes. They may have plane or flat surfaces, or they may have some surface curvatures, and they may be formed as extensions of the blades of the first set projecting towards the vertical axis.

The rotor preferably has a central end wall portion facing the central outlet, which is shaped, for example, frusto-conically to favor the flow of the gas stream towards the outlet.

Due to the second set of rotor blades, an important part of the kinetic energy of the gas stream is utilized for turning the rotor, which enables the power of the rotor entrainment motor to be reduced. Under certain operating conditions, it is even possible to do away entirely with a drive motor for the rotor and to mount the rotor for free rotation, in which case means for controlling the orientation of the guide vanes maintain the rotary speed of the freely rotatable rotor at a desired value, which determines the critical or cut-off diameter of the particles to be sorted.

To enable this critical or cut-off particle diameter to be determined with greater precision, it is advantageous to shape the vertical blades of the first set so that the channels defined between the adjacent vertical blades grow in width towards the vertical axis. In this way, the centrifugal and the centripetal drawing forces acting on the particles whose diameter is equal to the critical or cut-off diameter are substantially in equilibrium along the entire length of these flow channels.

As in known separators of this type, a housing surrounds the guide vanes and defines therewith an annular inlet chamber for the gas stream and, possibly, the particulate material to be sorted. The means for introducing the gas stream into this chamber may be arranged to introduce the gas stream through a lower end of the housing in a direction parallel to the vertical axis or tangentially thereto. The particulate material may be suspended in the gas stream before it is introduced in this inlet chamber or it may be introduced separately, from above, into the space between the rotor and the guide vanes. If desired, these two modes of feeding the particulate material to the separator may be utilized simultaneously.

In a preferred embodiment of the present invention, the separator comprises a hopper having an inverted cone shape positioned below the guide vanes and the rotor for receiving particles having dimensions greater than the predetermined dimensions, a cylindrical housing surrounding the guide vanes and the hopper, the housing comprising means for evacuating the particles having dimensions greater than the predetermined dimensions, and the means for introducing the gas stream and the particulate material include a vertical inlet duct connected to a lower end of the cylindrical housing for introducing the gas stream charged with the particulate material, the hopper, the housing and the inlet duct being coaxial, and the diameter of the housing being substantially larger than that of the inlet duct in a plane where the inlet duct opens into the housing whereby the gas stream charged with the particulate material, upon entering the housing, is subjected to an expansion which favors the falling of the larger dimensioned particles to the bottom of the housing. The inlet duct may extend from the lower end of the housing upwardly into the housing and define therewith an annular expansion zone where the particles of greater dimensions separated from the gas stream are collected. The bottom of the separator housing is preferably inclined and has, at its lowest point, an evacuation outlet for the collected particles. One or more annular deflectors constituted by ring-shaped or frusto-conical baffles may be affixed to the hopper and spaced above an upper end of the inlet duct to deflect the gas stream and favor the separation of the largesized particles therefrom.

BRIEF DESCRIPTION OF THE DRAWING

The above and other objects, advantages and features of this invention will become more apparent from the following detailed description of now preferred embodiments thereof, taken in conjunction with the accompanying, somewhat diagrammatic drawing wherein.

DETAILED DESCRIPTION OF PREFERRED EMBODIMENT

Figure 1:
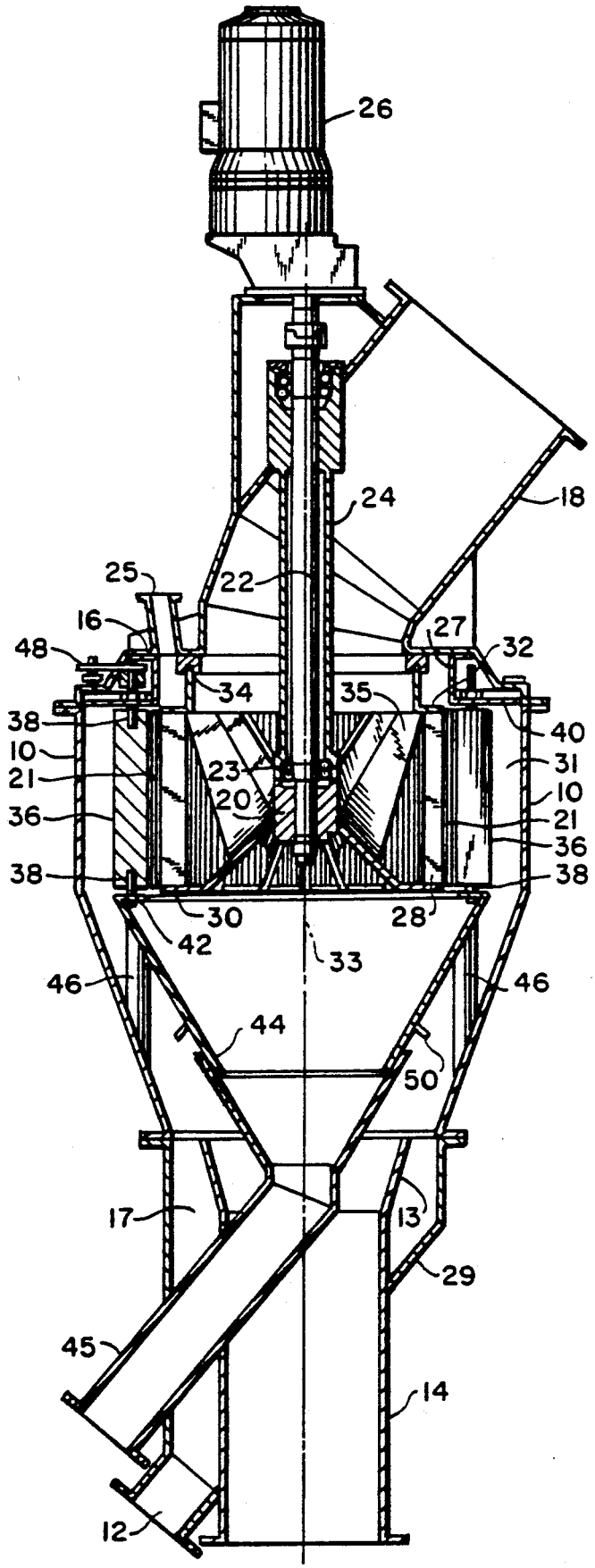
FIG. 1 shows a vertical section of a pneumatic centrifugal separator according to the invention.

Referring now to the drawing, there is shown a pneumatic centrifugal separator comprising guide vanes 36 disposed along the generatrices of fictitious cylinder 37 having vertical axis 33. Guide vanes 36 are adapted to impart to a gas stream entering the fictitious cylinder a rotary motion about the vertical cylinder axis. Rotor 20 is coaxially positioned in the interior of fictitious cylinder 37. The rotor is affixed to the inner end of vertical shaft 22 mounted by roller or ball bearings 23 in tubular support 24 which is affixed to cover 16 closing the top of housing 10 surrounding guide vanes In the illustrated embodiment, the outer end of vertical shaft 22 is coupled to variable-speed drive motor 26 which permits rotor 20 to be turned at a desired speed.

The rotor is equipped with a first set of a great number of vertical blades 28 distributed uniformly along the periphery of the rotor and a second set of blades 35 disposed between blades 28 of the first set and cylinder axis 33. Means is provided for introducing a gas stream and particulate material to be sorted between guide vanes 36 and rotor 20, which in the illustrated embodiment includes vertical inlet duct 14 connected to a lower end of cylindrical housing 10 for introducing the gas stream charged with the particulate material. The housing surrounds guide vanes 36 and defines therewith annular inlet chamber 31 for the gas stream. Housing 10 has a cylindrical upper portion surrounding rotor 20, an intermediate inverted frusto-conical portion and a lower cylindrical portion connected to the small base of the inverted frusto-conical housing portion and having inclined bottom 29 which, at its lowest point, has evacuating outlet 12. Inlet duct 14, rotor 20 and housing 10 are coaxially arranged, and the inlet duct has widened, outwardly flaring mouth 13 at a discharge end thereof. The upper housing portion is closed by cover 16 defining a central outlet opening through which the gas stream charged with particles of dimensions smaller than predetermined dimensions and sorted out of the particulate material is drawn out into evacuating duct 18 attached to the rim of the cover surrounding the central outlet opening. The second set of blades 35 is arranged to guide the streams of gas coming through channels between adjacent vertical blades 28 of the first set to the central outlet and duct 18. In the illustrated embodiment, blades 35 of the second set extend over the entire height of the rotor and define radially extending planes (see FIG. 2).

Illustrated rotor 20 has end wall 30 facing the central outlet and shaped to favor the flow of the gas stream towards the outlet, the end wall having a planar annular portion surrounding a central frusto-conical portion affixed to the central rotor body. The opposite ends of vertical blades 28 are affixed, respectively, to the annular end wall portion and ring 32; joints 34 assure fluid-tight a connection between the cover and the rotor, end wall 30 and upper ring 32 defining the height of rotor 20.

Figure 2:
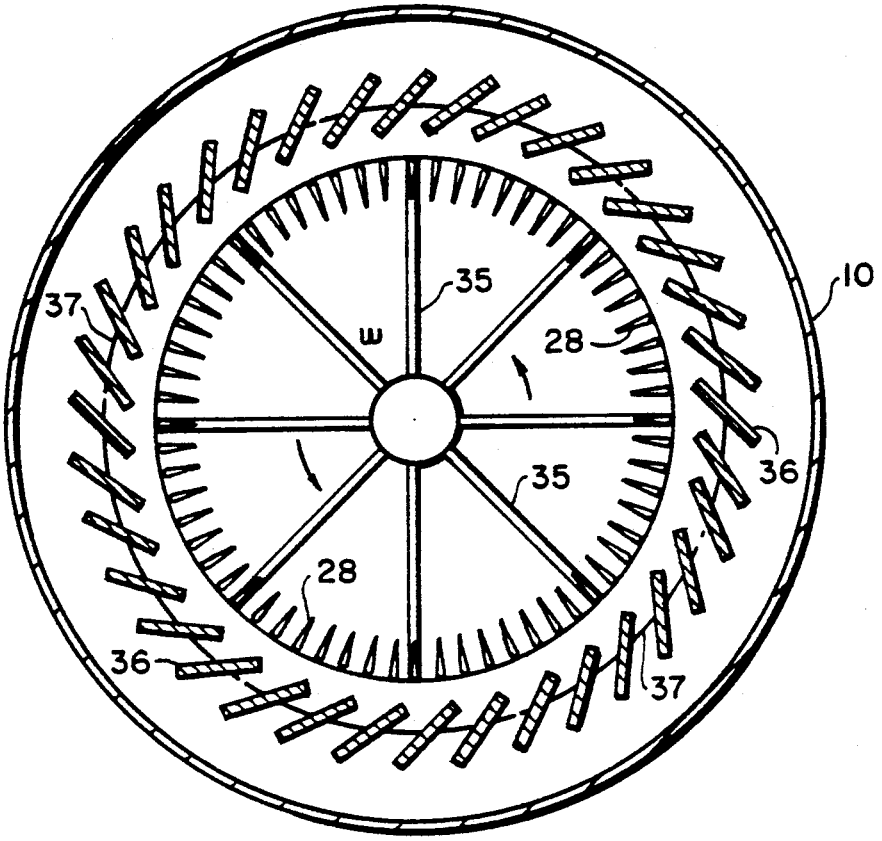
FIG. 2 is a transverse horizontal section of the separator of FIG. 1.
Figure 3:
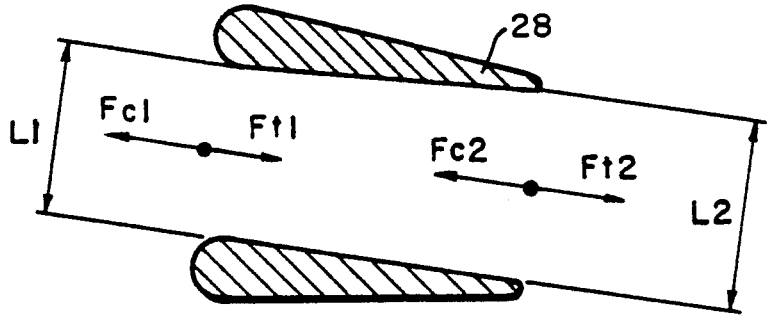
FIG. 3 is an enlarged transverse section showing two adjacent rotor blades of the first set, with the flow channel defined therebetween.

Vertical rotor blades 28 have a plane of symmetry passing through vertical axis 33, as can be seen in FIG. 2, and as best shown in FIG. 3, vertical blades 28 of the first set are so shaped that the channels defined between the adjacent vertical blades grow in width towards vertical axis 33 , i.e. from the exterior towards the interior of the separator. In other words, exterior width L1 is smaller than interior width L2 so that the centrifugal force and the centripetal drawing forces acting on the particles having the predetermined critical or cut-off diameter are in substantial equilibrium along the entire length of the channels. Terming the centrifugal and centripetal forces at the entrance of a channel Fc1 and Ft1, and Fc2 and Ft2 at the exit of the channel, the operating conditions may be expressed in the following equations:

$$Fc1 = Ft1$$

$$Fc2 = Ft2$$

The shape of vertical blades 28 may be readily determined on the basis of these mathematical equations which translate the equilibrium of the centrifugal and drawing forces acting on a particle of a given density and diameter, with a given rotary speed of the rotor. The equilibrium conditions may be satisfied, for a given shape of the vertical rotor blades, for different critical or cut-off particle diameters by changing the rotary speed of the rotor.

Instead of being radially oriented, rotor blades 28 may enclose an angle with the radial planes as long as the width of the channels defined between adjacent blades progressively increases from the exterior towards the interior of the separator.

In the illustrated embodiment, rotor blades 35 are constituted by planar metal sheets extending in vertical planes passing through axis 33 (see FIG. 2) and having their opposite ends affixed, respectively, to the central frustoconical portion of rotor bottom 30 and upper ring 32. These blades avoid the formation of a vortex in the interior central portion of the rotor and permit an important part of the energy of the gas stream traversing the rotor to be recovered. Blades 35 may be inclined with respect to the vertical planes passing through axis 33 and they may be shaped like turbine blades. Such a rotor is assimilable to the rotor of a centrifugal compressor which would operate as a receiving turbo machine taking energy from a continuous fluid flux and transforming it into mechanical energy.

This rotor construction makes it possible to suppress the central vortex which would be formed in the absence of blades 35 and, therefore, to recover energy which would be lost in the vortex, and to reduce the wear on the particulate material due to abrasion by reducing the flow speed of the gas stream.

Figure 4:
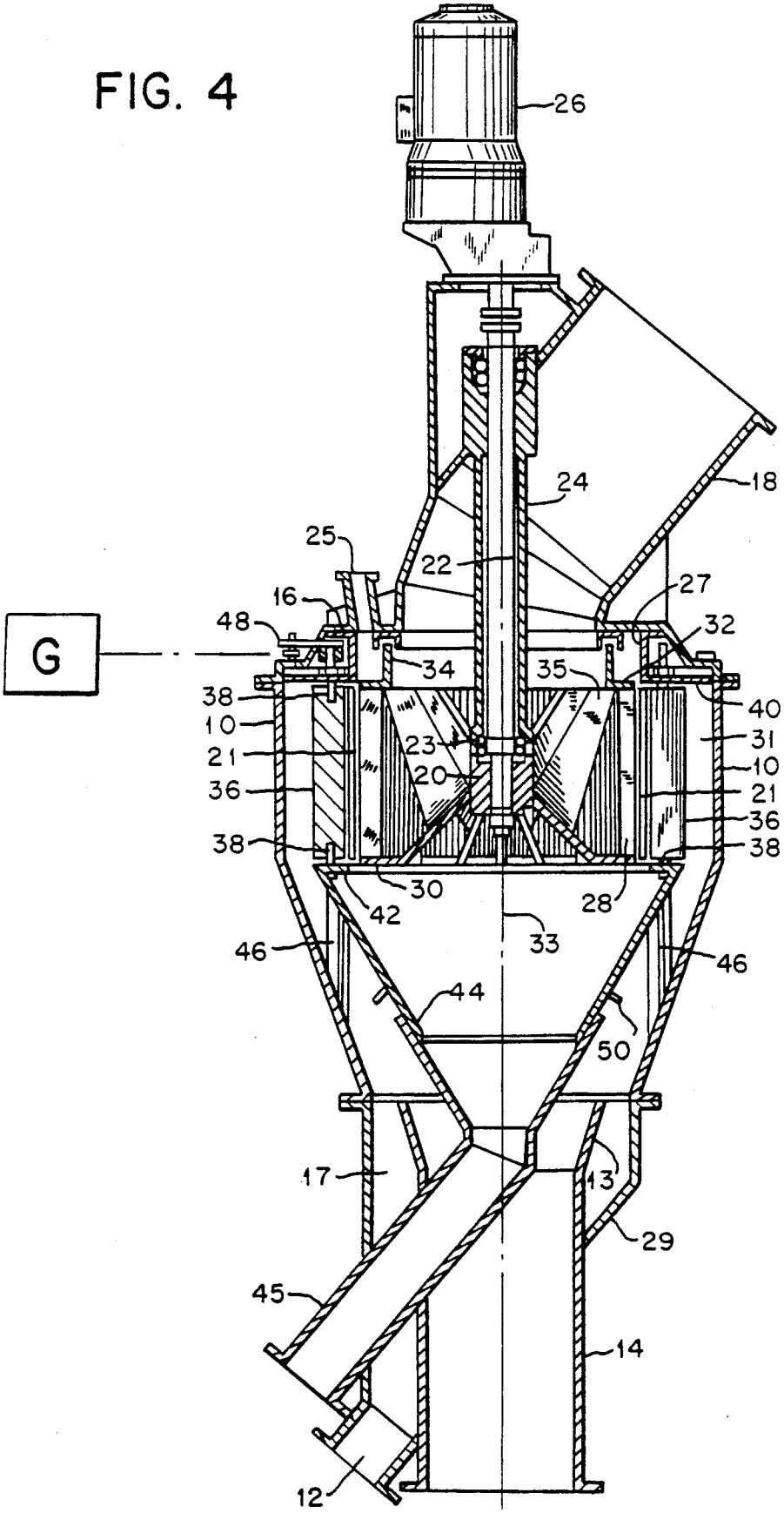
FIG. 4 shows a modified embodiment of the separator of FIG. 1.

The opposite ends of guide vanes 36 are mounted by pivots 38 on upper ring 40 and lower ring 42, respectively, and upper pivots 38 are equipped with lever arms 48 interconnected by a loop so that the orientation of guide vanes 36 may be remote-controlled by a governor G acting on the loop as shown in FIG. 4, which is the same as FIG. 1 but shows motor 26 uncoupled from drive shaft 22. In this way, if the upper end of drive shaft 22 is uncoupled from motor 26 and rotor 20 is mounted for free rotation, the rotary speed of the freely rotatable rotor may be maintained at a desired value depending on the set orientation of the guide vanes. Whatever the orientation of the guide vanes, all guide vanes enclose the same angle with a respective radial plane.

The illustrated pneumatic centrifugal separator comprises hopper 44 having an inverted cone shape positioned below guide vanes 36 and rotor 20 for receiving particles having dimensions greater than the predetermined dimensions. Upper support ring 40 for the guide vanes is affixed to the cylindrical upper portion of housing 10 surrounding the guide vanes and lower support ring 42 is affixed to the upper rim of hopper 44. Housing 10 comprise means for evacuating the particles having dimensions greater than the predetermined dimensions, which includes inclined housing bottom 29 and outlet duct 12. Hopper 44, housing 10 and the inlet duct 14 are coaxial, and the diameter of housing 10 is substantially larger than that of inlet duct 14 in a plane where the inlet duct opens into the housing whereby the gas stream charged with the particulate material, upon entering the housing, is subjected to an expansion which favors the falling of the larger dimensioned particles to the bottom of the housing.

In the illustrated embodiment, inlet duct 14 extends from the lower end of housing 10 upwardly into the housing and defines therewith annular space 17 where the particles of greater dimensions are collected. As shown, one or more annular deflectors 50 may be affixed to hopper 44 and spaced above an upper end of inlet duct 14 to improve the separation.

The above-described pneumatic centrifugal separator operates in the following manner:

A stream of gas charged with particulate material to be sorted is introduced into inlet duct 14 to flow upwardly therein to widened discharge mouth 13 whence it enters an expansion chamber between housing 10 and inlet duct 14, where it is subjected to a sudden expansion and a corresponding reduction in the flow velocity of the gas stream. This permits the larger particles to fall to the bottom of housing 10 through annular space 17 and down chute 29 for evacuation through outlet 12. The separation of these heavy particles is facilitated by the arrangement of deflectors 50 above the discharge mouth of inlet duct 14.

The gas stream, from which the large-sized particles have been separated, then rises to the cylindrical upper portion of housing 10 while maintaining a substantially constant flow velocity, flows between guide vanes 36 inwardly, which impart a circular motion to the gas stream, and enters rotor 20 through the channels between adjacent vertical blades 28. The particles of dimensions less than those of the predetermined critical or cut-off diameter are entrained in the rotor by the flowing gas stream and are evacuated with the gas stream through outlet duct 18. The outlet duct is connected to the input of a suction fan through a dust separator or filter which enables the particles to be separated from the gas stream being sucked out of the separator by the fan.

The particles having dimensions exceeding the predetermined critical or cut-off diameter are retained outside rotor 20 by centrifugal force and they will fall by gravity into hopper 44 through an annular slot between the rotor and lower support ring 42. If a large particle accidentally enters one of the channels between vertical rotor blades 28, it will be thrown outwardly because the shape of these channels is such that the centrifugal force acting on such a particle exceeds the centripetal force drawing it inwardly along the length of the channel. The particles collected in hopper 44 are evacuated by outlet duct 45 attached to the hopper.

If desired, at least a fraction of the particulate material to be sorted may be introduced into the separator through one or more inlets 25 disposed above support ring 32 of rotor 20 and projected by centrifugal force against skirt 27 affixed to cover 16 and surrounding ring 32, falling into annular space 21 between guide vanes 36 and rotor 20 where this particulate material is suspended in the gas stream circulating transversely therethrough.

For a given gas throughput, the critical or cut-off diameter of the particles to be sorted through the central outlet depends on the rotary speed of rotor 20. This is maintained at the desired value by controlling the speed of motor 26. Since the power transmitted to the rotor by the gas stream which traverses it may exceed that required to turn the rotor at the desired speed, motor 26 must have controllable braking power. The orientation of guide vanes 36 is adjusted in dependence on the rotor speed so that the tangential component of the flow velocity of the gas stream and of the particulate material at the periphery of the rotor is approximately equal to the peripheral speed of the rotor. This adjustment may be effected manually or automatically, and it prevents the particles from being thrown against the rotor blades with heavy impact as well as assuring a homogeneous fluid velocity over the entire width of the channels between the rotor blades.

Under certain operating conditions and as shown in FIG. 4, the upper end of drive shaft 22 may be uncoupled from motor 26 (or no motor may be provided) so that the rotor is mounted for free rotation. In this case, the desired rotor speed is maintained to adjust to the critical or cut-off particle diameter by pivoting guide vanes 36 about their axes to orient them suitably in the above-indicated manner. This arrangement provides considerable economies because it not only does away with the motor (and its power requirements) but also makes it possible to use a much lighter support structure for the rotor.

Instead of introducing the gas stream axially from below, as in the illustrated embodiment, the gas stream could be introduced tangentially into housing 10 at the level of guide vanes 36.

In the illustrated embodiment, the progressive increase in the cross section of the channels between rotor blades 28 from their entrance to their exit has been realized by an increase in their width. However, it is also possible to increase their height by substituting frusto-conical rings for the flat annular portions of end wall 30 and flat ring 32, with the large base of the frusto-conical rings facing the rotor blades.

What is claimed is:

1. A pneumatic centrifugal separator comprising (a) guide vanes disposed along the generatrices of a fictitious cylinder having a vertical axis, the guide vanes being adapted to impart to a gas stream entering the fictitious cylinder a rotary motion about the vertical cylinder axis, (b) a rotor coaxially positioned in the interior of the fictitious cylinder, the rotor being equipped with (1) a first set of vertical blades distributed uniformly along the periphery of the fictitious cylinder and (2) a second set of blades disposed between the blades of the first set and the cylinder axis, (c) means for introducing a gas stream and particulate material to be sorted between the guide vanes and the rotor, and (d) a central outlet through which the gas stream charged with particles of dimensions smaller than predetermined dimensions and sorted out of the particulate material is drawn out, (1) the second set of blades being arranged to guide the streams of gas coming through channels between adjacent ones of the vertical blades of the first set to the central outlet.

2. The pneumatic centrifugal separator of claim 1, wherein the rotor has an upper end and a lower end, the blades of the second set extending between the rotor ends.

3. The pneumatic centrifugal separator of claim 2, wherein the blades of the second set define radially extending planes.

4. The pneumatic centrifugal separator of claim 1, wherein the rotor has an end wall facing the central outlet and shaped to favor the flow of the gas stream towards the outlet.

5. The pneumatic centrifugal separator of claim 1, wherein the rotor is mounted for free rotation, and further comprising means for controlling the orientation of the guide vanes so as to maintain the rotary speed of the rotor at a desired value.

6. The pneumatic centrifugal separator of claim 1, wherein the vertical blades of the first set are so shaped that the channels defined between the adjacent vertical blades grow in width towards the vertical axis.

7. The pneumatic centrifugal separator of claim 1, further comprising a housing surrounding the guide vanes and defining therewith and annular inlet chamber for the gas stream.

8. The pneumatic centrifugal separator of claim 7, wherein the means for introducing said gas stream and particulate material comprises means for introducing at least a fraction of the particulate material from above between the guide vanes and the rotor, and separate means for introducing the gas stream into the annular inlet chamber.

9. The pneumatic centrifugal separator of claim 7, wherein the means for introducing the gas stream is arranged to introduce the gas stream through a lower end of the housing.

10. The pneumatic centrifugal separator of claim 1, comprising (a) a hopper having an inverted cone shape positioned below the guide vanes and the rotor for receiving particles having dimensions greater than the predetermined dimensions, (b) a cylindrical housing surrounding the guide vanes and the hopper, (1) the housing comprising means for evacuating the particles having dimensions greater than the predetermined dimensions, and (c) the means for introducing the gas stream and the particulate material including a vertical inlet duct connected to a lower end of the cylindrical housing for introducing the gas stream charged with the particulate material, (1) the hopper, the housing and the inlet duct being coaxial, and (2) the diameter of the housing being substantially larger than that of the inlet duct in a plane where the inlet duct opens into the housing whereby the gas stream charged with the particulate material, upon entering the housing, is subjected to an expansion which favors the falling of the larger dimensioned particles to the bottom of the housing.

11. The pneumatic centrifugal separator of claim 10, wherein the inlet duct extends from the lower end of the housing inwardly into the housing and defines therewith an annular space where the particles of greater dimensions are collected.

12. The pneumatic centrifugal separator of claim 10, further comprising one or more annular deflectors affixed to the hopper and spaced above an upper end of the inlet duct.

* * * * *